US007992540B2

(12) United States Patent
Bianchi

(10) Patent No.: US 7,992,540 B2
(45) Date of Patent: Aug. 9, 2011

(54) DECOMPRESSION BRAKING DEVICE IN ENDOTHERMIC ENGINES

(75) Inventor: Pietro Bianchi, Turin (IT)

(73) Assignee: IVECO S.p.A., Turin (IT)

( * ) Notice: Subject to any disclaimer, the term of this patent is extended or adjusted under 35 U.S.C. 154(b) by 935 days.

(21) Appl. No.: 11/985,639

(22) Filed: Nov. 16, 2007

(65) Prior Publication Data

US 2008/0121477 A1 May 29, 2008

(30) Foreign Application Priority Data

Nov. 28, 2006 (IT) ..... MI2006A2289

(51) Int. Cl.
*F02D 13/04* (2006.01)
*F01L 1/34* (2006.01)

(52) U.S. Cl. ..... 123/321; 123/90.16

(58) Field of Classification Search ..... 123/90.15, 123/90.16, 90.39, 90.41, 320–322, 347, 568.14; 188/273

See application file for complete search history.

(56) References Cited

U.S. PATENT DOCUMENTS 1,812,787 A 6/1931 Hewitt
2,880,711 A 4/1959 Roan
3,540,424 A * 11/1970 Dietel et al. ..... 123/182.1
4,664,233 A * 5/1987 Tsuchida et al. ..... 188/181 A
5,335,636 A 8/1994 Bilei et al.
5,611,308 A * 3/1997 Hackett ..... 123/321
5,816,216 A * 10/1998 Egashira et al. ..... 123/321
5,960,750 A * 10/1999 Kreuter ..... 123/48 B
6,032,643 A * 3/2000 Hosaka et al. ..... 123/321
6,257,201 B1 * 7/2001 Kajiura et al. ..... 123/321
6,354,265 B1 * 3/2002 Hampton et al. ..... 123/321
6,386,160 B1 * 5/2002 Meneely et al. ..... 123/90.16
6,412,453 B1 * 7/2002 Rao et al. ..... 123/48 B
6,497,203 B1 * 12/2002 Rao et al. ..... 123/48 B
6,622,669 B1 * 9/2003 Nageswar Rao et al. ... 123/48 B
6,701,885 B2 * 3/2004 Klomp et al. ..... 123/197.4
6,805,081 B2 * 10/2004 Watanabe et al. ..... 123/90.17
7,051,852 B2 * 5/2006 Maret ..... 188/300
RE39,258 E * 9/2006 Cosma et al. ..... 123/321
7,140,333 B2 * 11/2006 Persson et al. ..... 123/90.16
7,146,945 B2 * 12/2006 Persson ..... 123/90.16
7,392,772 B2 * 7/2008 Janak et al. ..... 123/90.12
2003/0226534 A1 * 12/2003 Watanabe et al. ..... 123/90.17
2004/0031347 A1 * 2/2004 Barnett ..... 74/502.2
2005/0211204 A1 9/2005 Todo et al.

* cited by examiner

*Primary Examiner* — Willis R Wolfe, Jr.
*Assistant Examiner* — Johnny H Hoang
(74) *Attorney, Agent, or Firm* — Stetina Brunda Garred & Brucker

(57) ABSTRACT

A decompression braking device in an endothermic engine (1) is provided of the type comprising a lever axle (2) on which a plurality of eccentric bushings (31) of a corresponding plurality of levers (3) provided with tappets (4) are rotationally and eccentrically mounted for actuating a plurality of exhaust valves (5), and a camshaft (30) for actuating the plurality of levers (3), the device is characterized in that it comprises an actuating member (6, 61) mounted externally to the lever axle (2) and connected to the latter by linkages (8, 9, 10), such that a respective rotation of the bushings (31) by a predetermined angular value (α), with consequent displacement of the hinging axis of the levers (3), corresponds to each excursion of the actuating member (6, 61).

9 Claims, 5 Drawing Sheets

DECOMPRESSION BRAKING DEVICE IN ENDOTHERMIC ENGINES

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to an engine brake actuator device in endothermic engines and, more specifically, to a decompression engine brake actuating device in endothermic engines.

BRIEF SUMMARY

Today, the engine inertia braking principle, by decompression of the combustion chamber during the gas compression stroke, is widely known. Indeed, it is known to exploit the energy accumulated in the form of compressed gas pressure energy during the compression cycle to "brake" the inertia or the mass connected to the crankshaft.

In lack of adequate systems, following the compression of the gas, the latter would be expanded in the downward piston stroke at the same time as the opening of the exhaust valves. This solution would create an elastic effect which would in part tend to return the piston downwards due to the thrust generated on the latter by the compressed gas, thus disadvantageously decreasing the engine brake efficiency.

For some types of use where inertia is higher, such as, for example, heavy haulage, a solution contemplating the early opening of the exhaust valve(s) with respect to the piston linkage has been adopted. This is obtained by adding auxiliary exhaust valve openings by means of actuators of various designs. Such solution, despite being more effective than that above, implies the use of sophisticated mechanisms and/or actuators which act on the valve lever shaft or, in some cases, the provision of various cams or levers which are actuated as required.

EP 0 543 210 requires the rocker arms to be fitted on eccentric bushings, in turn mounted on a rocker arm axle. A hydraulic actuator when required turns the bushing, thus displacing the rotation centre of the rocker arm.

This solution, however, consequently contemplates the use of devices and/or actuators which increase the complexity of the linkages and therefore displays the disadvantage of being complicated, cumbersome and costly.

It is therefore the object of the present invention to solve the drawbacks and disadvantages of the state of the art by providing a decompression braking device in endothermic engines which is extremely simple to make and therefore highly reliable.

A further object of the present invention is to provide a rugged, small-size, low-maintenance and low-cost decompression braking device in endothermic engines.

Therefore the present invention provides a decompression braking device in endothermic engines according to claim 1.

BRIEF DESCRIPTION OF THE DRAWINGS

A detailed description of a preferred embodiment of the decompression braking device in endothermic engines of the present invention will now be provided, by way of non-limitative example, with reference to the accompanying drawings, in which.

Figure 2B:
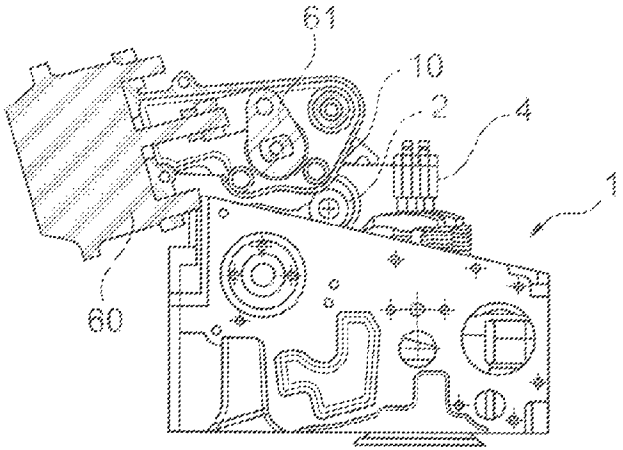
Figure 2C:
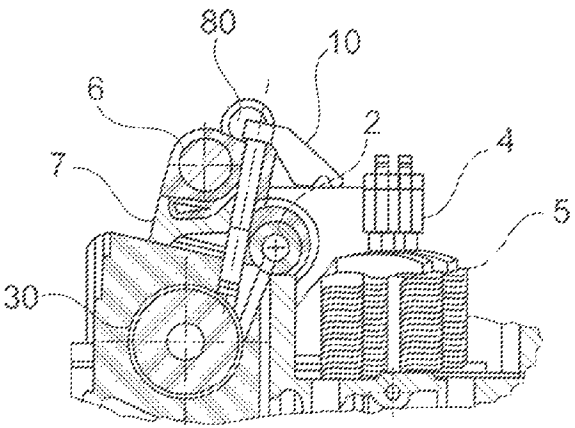
Figure 2D:
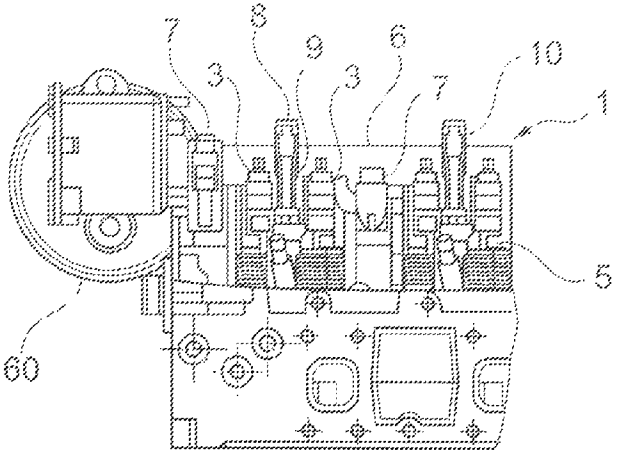
Figure 4:
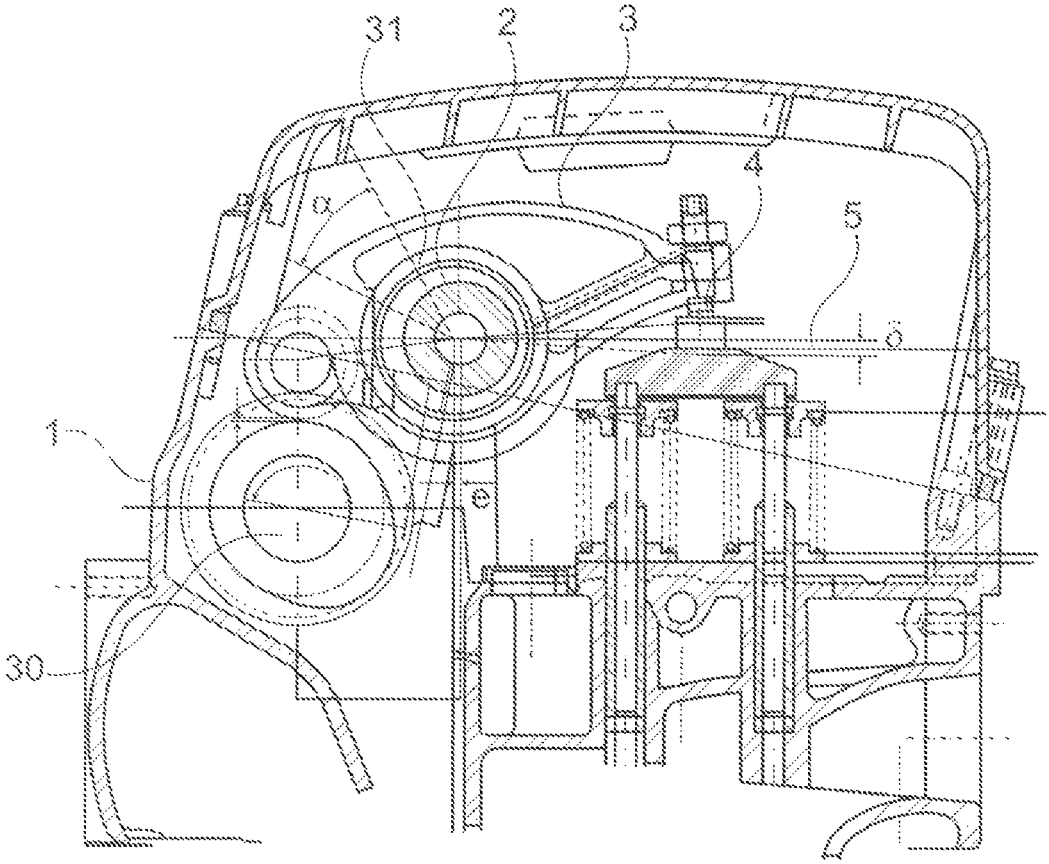
Figure 5C:
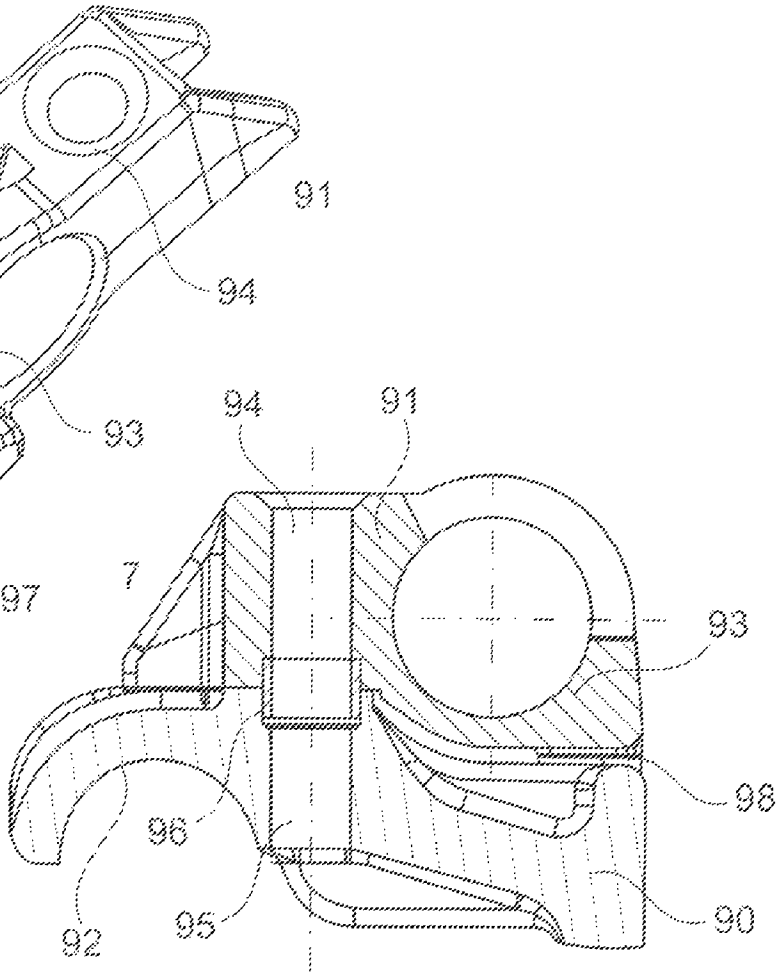
Figure 5B:
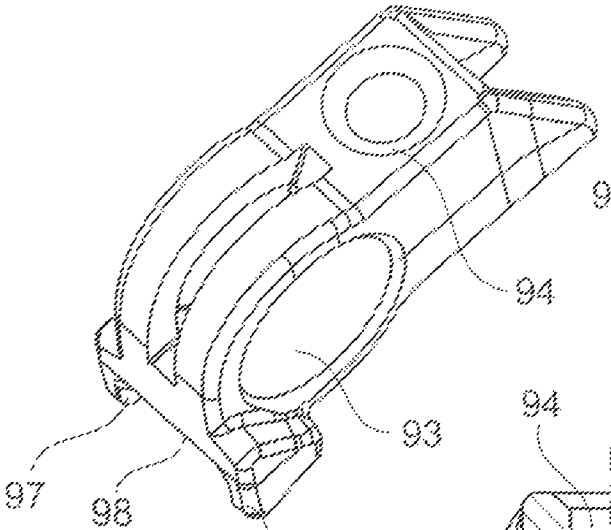
Figure 5A:
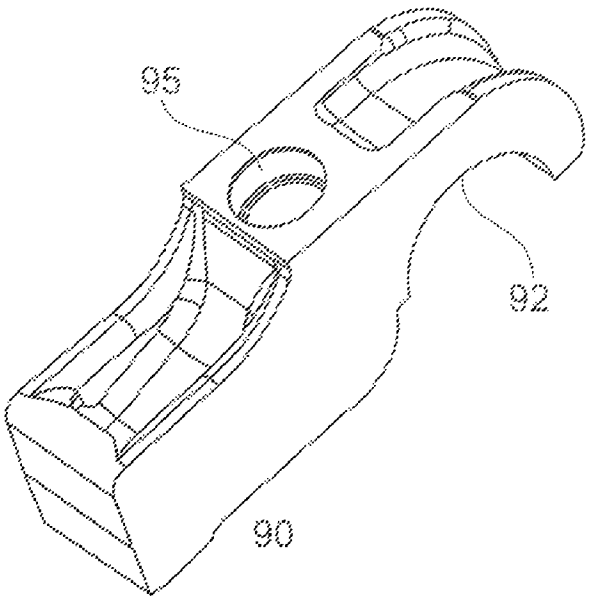

FIGS. from 2A to 2C are partial section views partially illustrating the braking device of the present invention;

FIG. 2D is a front view of the same cylinder head;

FIGS. from 3A to 3D show a component of the braking device of the present invention;

FIG. 4 is a partial section view schematically showing the decompression brake actuation principle by means of eccentric bushings;

FIGS. 5A and 5B are perspective view of two parts of a support belonging to the decompression braking device of the present invention;

FIG. 5C is a section view of parts of FIGS. 5A and 5B reciprocally assembled to constitute the support.

DETAILED DESCRIPTION

Figure 1:
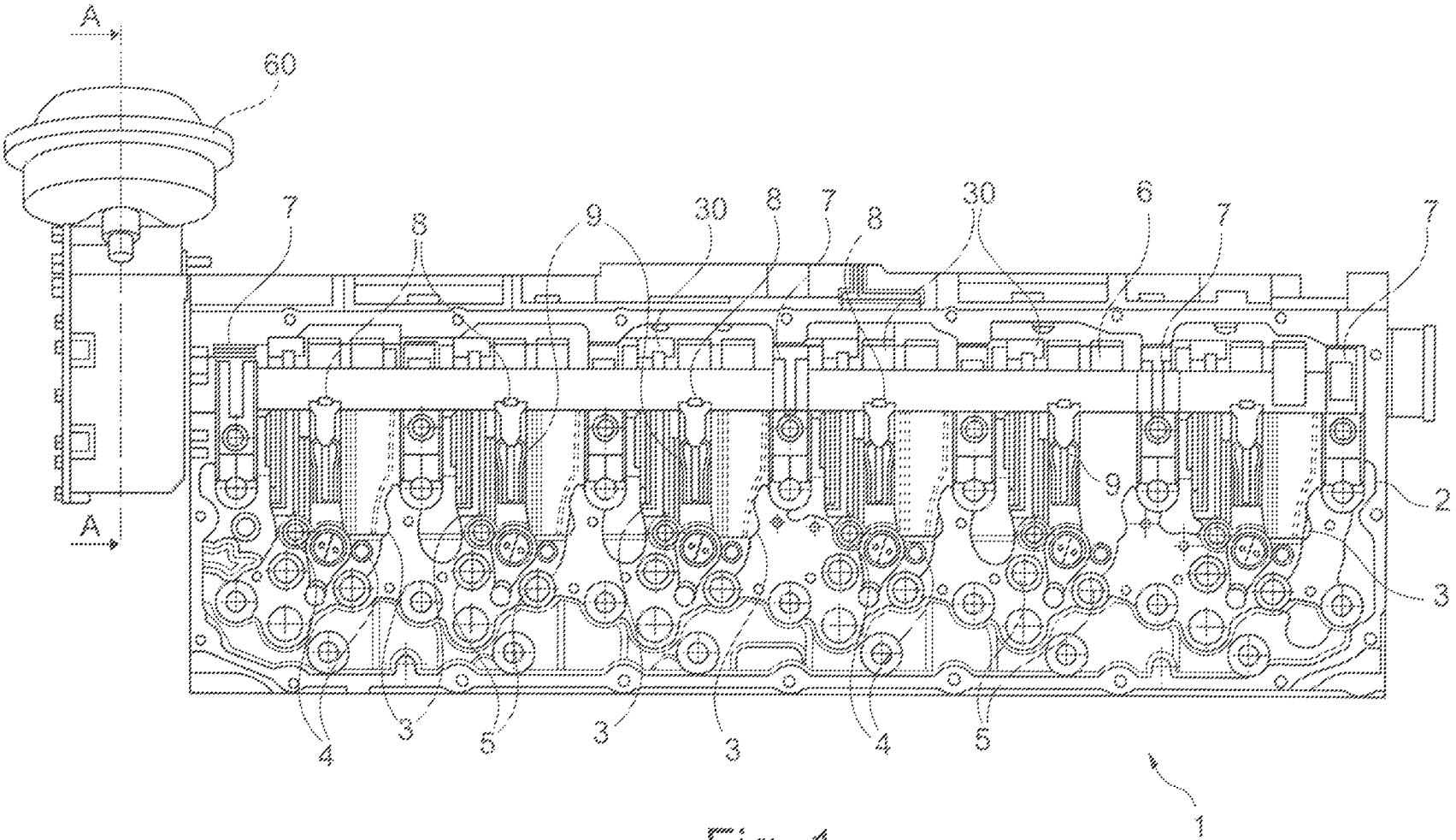
FIG. 1 is a top plan view of a cylinder head partially illustrating the decompression braking device of the present invention.

Referring now to FIG. 1, it is shown a head of an endothermic engine 1 which mounts the decompression braking device of the present invention. According to the invention, a lever axle 2 which rotationally mounts a plurality of levers 3 is provided, each lever 3 displays a tappet 4 which actuates one or more valves, in the case shown a pair of exhaust valves of which spring 5 is visible (actuation which occurs in a manner intrinsically already known and illustrated in better detail below). Each lever 3 is actuated by a corresponding cam integral with a camshaft 30 in the per se known manner.

A second actuating shaft 6 of the braking device according to the present invention is arranged on the top of lever axle 2. Shaft 6 is rotationally mounted on a corresponding plurality of supports 7 integrally arranged with the head of engine 1.

Furthermore, shaft 6 comprises a plurality of pins 8 integrally mounted on the first and each of which displays a spherically-shaped end 80 adapted to be hingingly connected to a corresponding plurality of arms 9 integrally mounted on a series of eccentric bushings 31 turnably supported by lever axle 2. Levers 3 are turnably mounted on eccentric bushings 31. The hinge connection between each pin 8 and arm 9 is obtained by a rigid element 10 (described in better detail below).

Furthermore, a shaft actuating device 60 (described in better detail below) integrally mounted on an appropriate part of the engine, e.g. on the cylinder head cover, is provided at the end of shaft 6.

Figures from 2A to 2D partially show some cross section views of the head of FIG. 1 incorporating the device of the present invention.

As one may note in the figures, supports 7 provide turnable support to shaft 6 so that each connection element 10 hinged between arm 8 and arm 9 thus forms a four-bar linkage; lever axle 2 is integral with the cylinder head and may, according to a particular embodiment of the invention, be maintained in position either by support 7 itself or in another appropriate manner.

More precisely and with specific reference to FIG. 2C, shaft 6 is parallel to lever axle 2. As apparent in the figure, connection element 10 connects shaft 6 to eccentric bushings 31 supported by axle 2 in virtue of corresponding pins 8 and arms 9 in a linking manner so that a rotation by a predetermined angle of shaft 6 is transformed into a predetermined reciprocal rotation of bushings 31.

Furthermore, with particular reference now to FIG. 2B, the figure shows actuator 60 which may be of the pneumatic type and is connected to shaft 6 by means of a lever 61 integral with the latter. The arrangement in the figure shows that a stroke of actuator 60 induces an angular excursion of shaft 6 and, consequently, due to the linkage illustrated above, also a corresponding angular excursion of bushings 31. It must be noted at this point that in virtue of the arrangement of actuator 60 connected to an end of shaft 6, the operation and the maintenance of the decompression braking device of the present invention is eased.

Figure 2A:
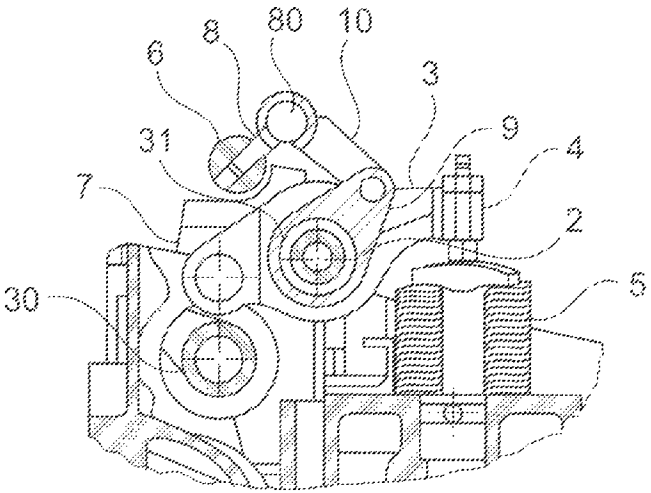
Figure 3D:
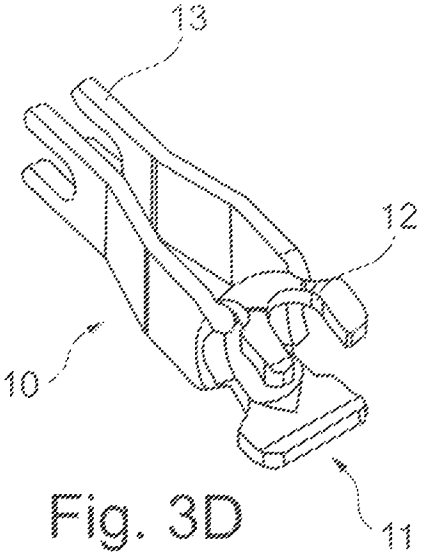
Figure 3C:
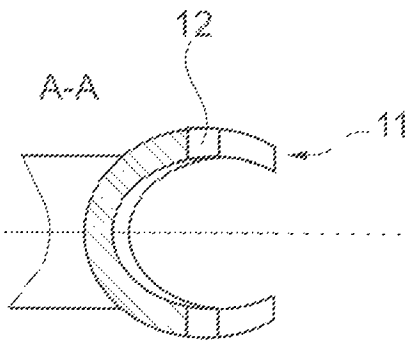
Figure 3A:
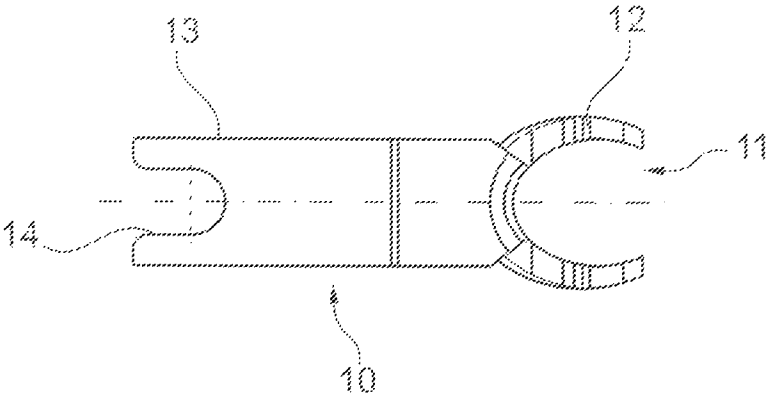
Figure 3B:
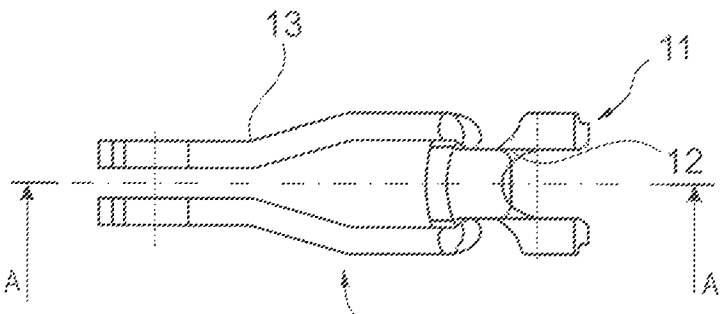

With particular reference now to FIG. 2A, the figure shows the linkage between shaft 6 and bushings 31 of levers 3. Specifically, each lever 3, corresponding to a pair of exhaust valves 5 of the cylinder head, is mounted on a bushing 31 as mentioned turnably supported by lever axle 2. Bushing 31, in turns, displays a predetermined eccentricity with respect to axle 2. Therefore, a rotation of bushing 31 by a predetermined angular value by means of element 10 on arms 9, actuated by actuator 60 by means of aforementioned linkage, is it possible to displace the rotation centre of lever 3 supported by bushing 31. With regard to the displacement of the rotation centre of the lever by means of rotation of the eccentric bushing, the system is similar to that described in EP 0 543 210. The systems differ instead with respect to the whole of the means for causing the rotation of the eccentric bushing, which is the object of the present invention.

With reference now to FIGS. 3A to 3D, different views of the conformation of the linkage element 10 are shown, according to a particular embodiment of the invention. As it may be noted in the figures, element 10 displays a first end 11 shaped in complementary manner to spherical end 80 of pin 8 integral with shaft 6. In this manner, once spherical end 80 is connected to such part 11, a pivoting connection is obtained between element 10 and pin 8, also in virtue of grooved region 12 where pin 8 may freely pivot for even greater angular values. The connection between spherical end 80 and part 11 is obtained by elastic insertion by interference and in the per se known manner.

On the other hand, and again with reference to FIGS. 3A-3D, the opposite end of element 10 consists of a fork-shaped part 13 adapted to swinging accommodate a corresponding arm 9 of bushing 31. End 13 displays engagement regions 14 with a corresponding connection pin integrally turnable on arm 9 (shown in better detail in FIG. 2B). Also in this case, the conformation of part 13 is such that arm 9 once connected to the latter may pivot within fork 13 (shown in better detail in FIGS. 1 and 2B).

With reference now to FIG. 4, this figure shows the decompression braking system already discussed above in better detail to which the device object of the present invention may be advantageously applied.

There is a cam portion on the opening profile of the camshaft exhaust valve such as to cause a shorter stroke than the clearance value normally existing between tappet and valve. By reducing such clearance by virtue of the eccentric displacement of the fulcrum of lever 3 with respect to axle 2, as shown in better detail below, such cam portion becomes active and an additional opening of the concerned valve is obtained.

As shown in the figure, lever 3 is turnably mounted on bushing 31 which in turn is turnably and eccentrically mounted on axle 2. Bushing 31 is mounted with predetermined eccentricity "e" so that, by its rotation by a value "□", performed by means of element 10 on arms 9 and corresponding linkage as previously described, it is possible to displace the rotation centre of lever 3, so as to reduce the clearance by a value "□".

Obviously, a rotation in the opposite direction of a value "−□" must be performed to eliminate the decompression braking effect of the gas within the cylinder thus returning the eccentricity "e" to the predetermined value if valve 5 is not actuated by the cam portion corresponding to compression braking.

Such rotation may be performed also without the need for additional return devices: indeed, lacking the action of the actuator, the force exerted on lever 3 during the actuation of the valve by the main cam portion is sufficient to return the bushing to its original position, a better control of the linkage may be obtained by adopting a possible return spring, not shown in the given example, which facilitates the return of the eccentric bushings to the position they occupied before the actuation of the actuator.

Lever axle 2 and shaft 6 are secured in any appropriate manner to the cylinder head, shaft 6 being free to rotate as mentioned.

According to a particular embodiment of the invention, described with the aid of FIGS. 5A, 5B, and 5C, supports 7 may comprise two parts, which are secured by means of screw to the head. Lower part 90 of FIG. 5A and upper part 91 of FIG. 5B are shown reciprocally assembled in FIG. 5C. The lower part displays a concave seat 92, adapted to press lever axle 2 against a specific seat on the cylinder head, holding it in position. The upper part displays an eyebolt 93 adapted to turnably accommodate shaft 6. A through screw in holes 94 and 95, reciprocally aligned to assembled parts and screwed into a threaded hole obtained on the cylinder head fixes support 7 to it, fastening the lever axle in its position. Cylindrical element 96, accommodated in specific seats obtained in the aforesaid holes, allows a precise and secure alignment. The conformation of the two parts 90 and 91 is such that eyebolt 93, on the opposite side with respect to the screw, rests on lower part 90 only by one end 98. Elements 97 favour centring. The two-part conformation, specifically with the described eyebolt resting system, allows to tighten the screw at a suitable torque, minimising the mechanical tensions on the eyebolt itself. Thus, deformations of the latter which could cause friction on shaft 6 are avoided. According to the invention, the decompression braking device shows a series advantages.

A first advantage results from the fact that the construction of the braking device thus designed is extremely simple and highly reliable.

Another advantage of the device is that being actuated from only one end of shaft 6, i.e. also from the outside of the tappet cover, the device reduces the dimensions within said cover, is rugged, low-maintenance and therefore also low-cost.

Furthermore, the actuator may be of any suitable type; indeed, an advantage of the present invention is that it is may be located externally to the engine and specifically to the tappet cover. In such a manner, no specific problems of compatibility arise with the environment where the actuator is located due, for example, to temperature, vibrations, presence of oil.

What is claimed is:

1. A decompression braking device in an endothermic engine (1) of a type comprising a head with at least one lever axle (2) on which a plurality of eccentric bushings (31) of a corresponding plurality of levers (3) are rotationally and eccentrically mounted, each lever (3) being provided with a tappet (4) for actuating one or more exhaust valves (5), and a camshaft (30) actuating said plurality of levers (3), the device comprising an actuating member (6, 61) mounted externally to said lever axle (2) and connected to said bushings by means of linkage means (8, 9, 10), an arrangement being such that a respective rotation of said bushings (2) by a predetermined angular value, with consequent displacement of a hinging axis of said levers (3), corresponds to each excursion of said actuating member (6, 61);

wherein said linkage means comprise a plurality of arms (9) arranged on said bushing (31), a plurality of pins (8) arranged on said actuating members (6), and a corresponding plurality of connection elements (10) each of which being hingingly mounted between an arm of said plurality of arms (9) and a pin of said plurality of pins (8), the arrangement being such that said plurality of arms (9), said plurality of pins (8), and said plurality of connection elements (10) form a four-bar linkage.

2. A decompression braking device in an endothermic engine (1) according to claim 1, wherein said actuating member comprises a shaft (6) arranged parallelly to said axle (2) of the levers (3) and mounted so as to turn about its axis.

3. A decompression braking device in an endothermic engine (1) according to the claim 1, wherein each pin (8) presents a spherical end (80) engaging with a corresponding complementary end (11, 12) obtained on a corresponding connection element (10), the arrangement being such that the hinged engagement between said spherical end (80) of said pin (8) and said complementary end (11, 12) of said connection element (10) is obtained by elastic interference coupling.

4. A decompression braking device in an endothermic engine (1) according to the claim 3, wherein said connection element (10) is made by bending an appropriate shaped plate.

5. The decompression braking device in an endothermic engine (1) according to claim 1, wherein each connection element (10) displays a fork-shaped end (13) adapted to swinging accommodate a complementary end of a corresponding arm (9) of said bushings (31), the arrangement being such that the hinged engagement between said fork-shaped end (13) and said arm (9) is obtained by means of a corresponding fastening pin mounted on said arm (9).

6. A decompression braking device in an endothermic engine (1) according to claim 1, wherein said actuating member further comprises an actuator (60) connected to said shaft (6) and adapted to actuate the latter (6) in rotation.

7. A decompression braking device in an endothermic engine (1) according to claim 6, wherein said actuator (60) is mounted externally to the tappet cover of the endothermic engine (1).

8. A decompression braking device in an endothermic engine (1) according to claim 2, wherein said shaft (6) and said axle (2) of the levers (3) are supported on a plurality of supports (7) integrally mounted on said head, and are arranged in a reciprocally parallel manner.

9. A decompression braking device in an endothermic engine (1) according to claim 8, wherein said supports (7) have two parts (90, 91) separately made, of which a lower one (90) adapted to withhold said axle lever (2) against the cylinder head, and an upper one (91), having an eyebolt (93) adapted to rotationally support said shaft (6).

* * * * *